US009635482B2

(12) United States Patent
Menke

(10) Patent No.: US 9,635,482 B2
(45) Date of Patent: Apr. 25, 2017

(54) WIRELESS AUDIO TRANSMISSION SYSTEM, IN PARTICULAR WIRELESS MICROPHONE SYSTEM

(71) Applicant: Sennheiser electronic GmbH & Co. KG, Wedemark (DE)

(72) Inventor: Claus Menke, Schneverdingen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/877,154

(22) Filed: Oct. 7, 2015

(65) Prior Publication Data

US 2016/0165373 A1 Jun. 9, 2016

(30) Foreign Application Priority Data

Oct. 7, 2014 (DE) ..... 10 2014 220 319

(51) Int. Cl.
*H04R 3/00* (2006.01)
*H04R 29/00* (2006.01)
*H04R 27/00* (2006.01)

(52) U.S. Cl.
CPC ..... *H04R 29/004* (2013.01); *H04R 3/005* (2013.01); *H04R 27/00* (2013.01); *H04R 2420/07* (2013.01)

(58) Field of Classification Search
CPC ..... H04R 3/002; H04R 3/005; H04R 3/12; H04R 1/1041; H04R 2420/01; H04R 2420/07; H04R 2460/13; H04R 29/00; H04R 5/04; H04R 5/033; H04R 2201/107; H04R 25/407; H04R 25/554; H04R 29/004; H04R 29/005; G06F 3/165; G10H 1/0058; G10H 1/0083; H04S 2400/15; H04M 1/6066
See application file for complete search history.

(56) References Cited

U.S. PATENT DOCUMENTS 5,432,858 A * 7/1995 Clair, Jr. ..... H04R 5/00 381/79
6,606,388 B1 * 8/2003 Townsend ..... G10H 1/125 381/1
7,088,832 B1 * 8/2006 Cooper ..... H04H 60/04 381/94.1
7,995,770 B1 * 8/2011 Simon ..... H04R 3/005 381/77
2003/0021426 A1 * 1/2003 Oogo ..... H04B 1/385 381/93
2005/0190936 A1 * 9/2005 Miura ..... H04S 1/002 381/309
2008/0058023 A1 3/2008 Seshadri et al.
(Continued)

*Primary Examiner* — Thang Tran
(74) *Attorney, Agent, or Firm* — Haug Partners LLP

(57) ABSTRACT

A wireless audio transmission system which has at least one wireless transmitter for the wireless transmission of a detected audio signal as a first audio signal by way of a first wireless transmission path. The wireless audio transmission system further has at least one in-ear monitor unit for directly receiving the first audio signal and for receiving a second audio signal. The first and second audio signals are mixed in the in-ear monitor unit and output as an output signal. The wireless audio transmission system has a mixing desk for mixing the first audio signal and further received audio signals to give an output signal which can be output to the public or recorded.

10 Claims, 2 Drawing Sheets

(56) References Cited

U.S. PATENT DOCUMENTS

| | | | | |
|---|---|---|---|---|
| 2010/0041447 | A1 | 2/2010 | Graylin | |
| 2012/0087507 | A1* | 4/2012 | Meyer | H04R 27/00 381/56 |
| 2012/0203364 | A1* | 8/2012 | Redmann | G11B 20/00855 700/94 |
| 2012/0314890 | A1* | 12/2012 | El-Hoiydi | H04R 25/558 381/315 |
| 2014/0254810 | A1 | 9/2014 | Abramsky et al. | |
| 2015/0146878 | A1* | 5/2015 | Meredith | G10K 11/178 381/71.6 |

* cited by examiner

WIRELESS AUDIO TRANSMISSION SYSTEM, IN PARTICULAR WIRELESS MICROPHONE SYSTEM

The present application claims priority from German Priority Application No. 10 2014 220 319.8 filed on Oct. 7, 2014, the disclosure of which is incorporated herein by reference in its entirety.

FIELD OF THE INVENTION

The present invention concerns a wireless audio transmission system, in particular a wireless microphone system.

FIG. 1 shows a schematic block circuit diagram of a wireless microphone system in accordance with the state of the art. A wireless microphone 110 generates an audio signal S and can transmit that signal as a first audio signal by way of the transmission path H1. A delay is typically added by the transmission path H1. The delayed audio signal S1 is then received at a mixing desk 130. Processing of the signal S1 takes place in the mixing desk 130. That can involve for example a change in volume or an equalizer but also other changes to the signal S1. That processing can be represented by a transmission function G. The transmission function G can also add a delay. The output from the transmission function is the processed audio signal S2. The audio signal S2 can additionally be passed to some other use in the mixing desk 130. Other audio signals E are also fed to the mixing desk 130. This involves for example the audio signals from other musicians involved in the performance. The processed audio signal S2 is added to the other audio signals E in the mixing desk 130, the audio signal M occurring as the output from the mixing desk 130.

The audio signal M is then transmitted by way of a wireless transmission means H2 to the in-ear monitoring system 150. The transmission path H2 typically adds a further delay. The audio signal M1 thus arrives at the in-ear monitoring system 30. That signal is then output to the user.

A wireless microphone system typically has a plurality of wireless microphones which serve to detect audio signals and wirelessly transmit them to a wireless receiver. The wirelessly received audio signals from the various wireless microphones can be mixed together for example in a mixing desk so as to give an overall audio signal. To be sure that for example singers also hear their own song a so-called in-ear monitor is typically used. An in-ear monitor typically has a wireless receiver for receiving the audio signals which are mixed for example in the mixing desk and for reproducing those audio signals to an earphone in an ear of the user. The in-ear monitor is typically carried on the body of the user. The user thus has the possibility of hearing both his own voice and also the mixed-together audio signal.

In the case of such a system however mixing of the direct sound in the head (by way of bone conduction sound) with the sound reproduced by way of the in-ear monitor (which is delayed by the wireless transmission) can give rise to comb filter effects in the ear, which can disturb a singer in his performance.

In the German patent application from which priority is claimed the German Patent and Trade Mark Office searched the following documents: US 2008/0058023 A1, US 2010/0041447 A1 and US 2014/0254810 A1.

SUMMARY OF THE INVENTION

Therefore the object of the present invention is to provide a wireless audio transmission system which reduces the risk of comb filter effects.

Thus there is provided a wireless audio transmission system which has at least one wireless transmitter for the wireless transmission of a detected audio signal as a first audio signal by way of a first wireless transmission path. The audio transmission system has a mixing desk unit for mixing the first audio signal and further received audio signals to give a first output signal which can be output to the public or recorded. The mixing desk unit outputs a second output signal based on the further audio signals. That second output signal is transmitted to the monitor unit by way of the third transmission path. The audio transmission system further has at least one (in-ear) monitor unit for directly receiving the first audio signal and for receiving a second output signal from the mixing desk unit. The first audio signal and the second output audio signal are mixed in the (in-ear) monitor unit and output as an output signal.

The wireless transmitter can be in the form of a wireless microphone or a wireless pocket transmitter (that is to say for example a wireless bodypack transmitter which receives a signal to be transmitted by way of an audio connection).

It is thus possible to ensure direct transmission of the first audio signal from the transmitter to the in-ear monitor unit, that transmission involving a low degree of latency.

In an aspect of the present invention the wireless microphone or the pocket transmitter has a wireless transmitter for wirelessly transmitting the first audio signal based on a first transmission protocol. The in-ear monitor unit has a wireless receiver for receiving the wirelessly transmitted audio signal based on the first transmission protocol.

The direct transmission of the first audio signal from the microphone or the pocket transmitter to the in-ear monitor unit can be effected directly and based on the same transmission protocol as the transmission from the microphone or the pocket transmitter to the first wireless receiver. Thus only one transmission protocol is required.

In a further aspect of the present invention the wireless microphone or the pocket transmitter has a first and a second transmitter, wherein the first transmitter sends the first audio signal based on a first transmission protocol and the second transmitter sends the first audio signal based on a second transmission protocol. The in-ear monitor unit has a first receiver for receiving the first audio signal based on the first transmission protocol and a second receiver for receiving the second audio signal based on the second transmission protocol. The first and second audio signals are mixed in the in-ear monitor unit and output as an output signal.

The invention concerns the idea of providing a wireless microphone system having at least one wireless microphone. The microphone has a first wireless transmitter for wirelessly transmitting first detected audio signals. The microphone system further has a first receiver for wirelessly receiving the first audio signal transmitted by the microphone. Optionally the microphone system can have a mixing desk serving to mix the first audio signal with other audio signals. The first audio signal and/or the mixed audio signals can be wirelessly transmitted by a second transmitter to a bodypack or an in-ear monitor (for example worn on the body of the user). The audio signal wirelessly transmitted by the first transmitter can also be received by the bodypack or the in-ear monitor. For that purpose the in-ear monitor can have one or two receivers for the corresponding receiving/transmitting frequencies. In that way the audio signal detected by the microphone is transmitted both to the in-ear monitor and also to the first receiver. The received first audio signal is then mixed with the second audio signal (from the second receiver) in the in-ear monitor/bodypack and the result can then be output so that the user can hear that signal by way of an earphone. Because the first audio signal is transmitted from the microphone directly to the in-ear monitor unit there is no great difference in transit time between that signal and the signal transmitted by way of bone conduction sound so that in this case the above-described comb filter effects do not arise.

Further configurations of the invention are subject-matter of the appendant claims.

Advantages and embodiments by way of example are described more fully hereinafter with reference to the drawing:

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

According to the invention the wireless audio transmission system has a wireless transmitter (for example a wireless microphone, a wireless instrument transmitter, for example a wireless guitar transmitter) or a wireless pocket transmitter)) for wirelessly transmitting a detected audio signal, at least one (in-ear) monitor unit and at least one mixing desk unit. The mixing desk unit can be in the form of a mixing desk or a computer with a suitable audio processing functionality and serves for bringing together various audio signals and for generating a common output signal which can be output to the public or which can be recorded. The mixing desk unit or the mixing desk can receive various audio signals and can respectively process the received audio signals. Additionally or alternatively the mixing desk can also process the mixed-together audio signals.

According to the invention an (in-ear) monitor unit is a portable wireless unit, by way of which an audio signal can be transmitted and output for example by means of an earphone. The output signal of the (in-ear) monitor unit, that is reproduced by way of the earphone (for example an in-ear earphone) can be adjusted at the mixing desk and thus tailored to the needs of the user. The monitor unit can be in the form of an in-ear monitor unit and can have an in-ear earphone which can be placed in an ear of the user.

Figure 1:
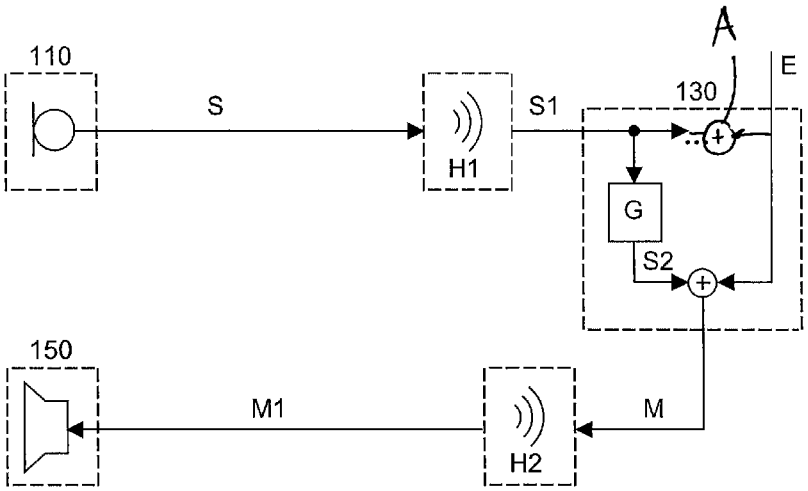
Fig. 1 (prior art)
FIG. 1 shows a schematic block circuit diagram of a wireless microphone system according to the state of the art.
Figure 2:
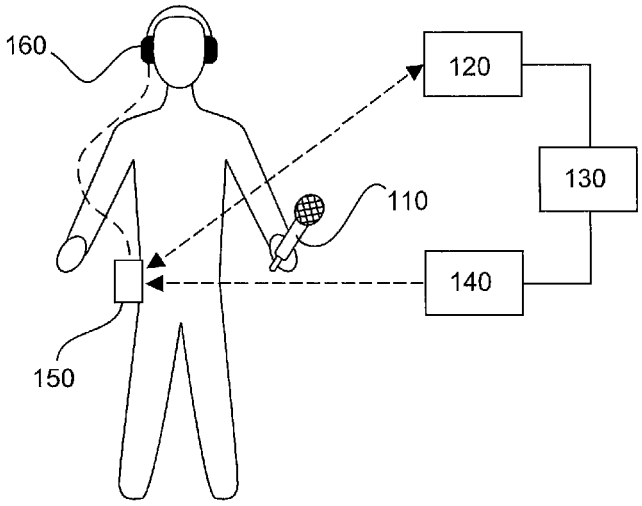
FIG. 2 shows a diagrammatic view of an arrangement of a wireless microphone system according to a first embodiment.

FIG. 2 shows a diagrammatic view of an arrangement of a wireless audio transmission system, for example a microphone system according to a first embodiment. The wireless audio system according to the invention can be in the form of a wireless microphone system and has at least one wireless microphone 110 for detecting and wirelessly transmitting a first audio signal by way of first and second wireless transmission paths H1, HD, at least one wireless receiver 120 for receiving the first audio signal wirelessly transmitted by way of the microphone, optionally an audio processing means, in particular a mixing desk or a mixing desk unit 130 and a transmitter 140 which wirelessly transmits the audio signal from the audio processing means (that is to say the mixing desk unit) as a second audio signal. The output signal of the mixing desk can represent a combination of further audio signals (but without the signal of the wireless transmitter). The wireless microphone system 100 also has at least one (wireless) (in-ear) monitor unit 150 which for example can be worn on the body of a user (for example as a bodypack). The (in-ear) monitor unit 150 receives directly both the first audio signal transmitted by the microphone 110 and also the second audio signal transmitted by the transmitter 140. The first and second audio signals can be mixed in the (in-ear) monitor unit 150 and the mixed signal, that is to say the output audio signal, can be output by way of an output. A user can connect an earphone 160 to the output of the (in-ear) monitor unit 150 and can thus hear the audio signal mixed from the first and second audio signals.

According to the invention the output signal of the mixing desk 130 does not have the first audio signal. Thus the in-ear monitor unit 150 can receive the first audio signal only directly from the microphone 110. The mixing desk 130 is for that purpose in a position to mix first audio signals S1 and the further audio signals E and output same as an output signal A. That output signal A can be reproduced to a public or can be subjected to audio recording.

According to the invention instead (or in addition to) a wireless microphone or microphones, it is possible to provide a wireless pocket transmitter.

Figure 3:
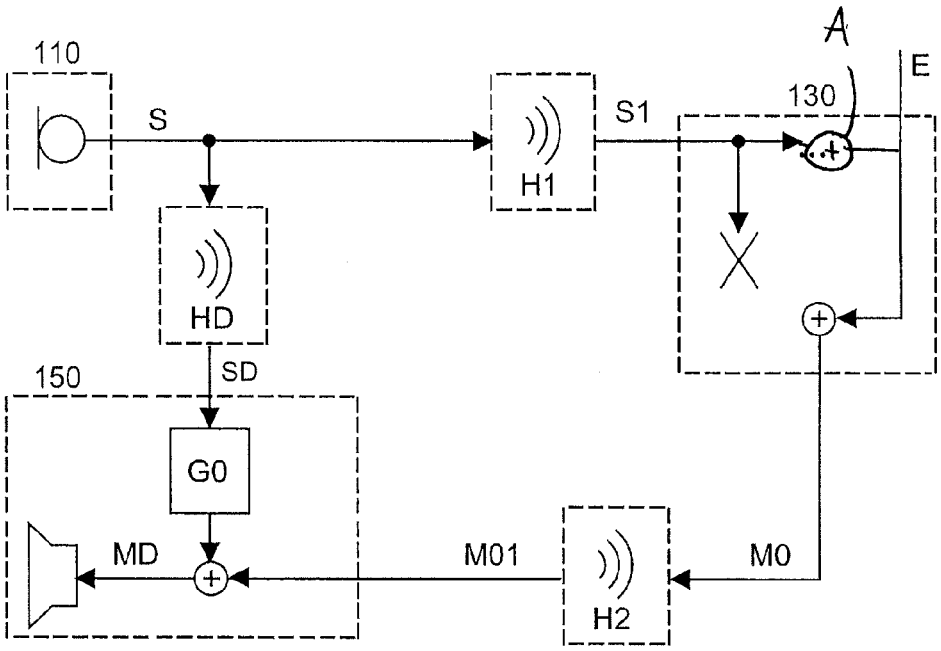
FIG. 3 shows a schematic block circuit diagram of a wireless audio transmission system according to a first embodiment of the invention.

FIG. 3 shows a schematic block circuit diagram of a wireless audio transmission system according to a first embodiment. This embodiment represents the preferred embodiment. The wireless transmission system according to the first embodiment can be in the form of a wireless microphone system having at least one wireless transmitter (for example wireless microphone) 110, an audio processing unit 130, in particular a mixing desk unit and at least one (in-ear) monitor unit 150.

The wireless microphone 110 generates an audio signal S and can transmit that signal as a first signal S by way of the first transmission path H1. A delay is added by the first transmission path H1 so that a delayed audio signal S1 then arrives at the mixing desk unit 130. Processing of the signal can be effected in the mixing desk unit 130. That can involve for example a change in volume or an equalizer or another audio processing step.

The first delayed audio signal S1 is not passed to the output of the mixing desk in the mixing desk 130 according to the first embodiment. The mixing desk 130 can receive other audio signals E, mix them and output them as an output audio signal M0. That output audio signal M0 can be transmitted by way of a third transmission path H2 to the (in-ear) monitor unit 150. The wireless microphone 110 (as a wireless transmitter) transmits a detected audio signal as a first audio signal S by way of a first wireless transmission path H1 and a second (wireless) transmission path HD.

The mixing desk 130 generates an output signal M0 in which the audio signal S1 is not contained. The third wireless transmission means H2 gives rise to the audio signal M01 which is received by the (in-ear) monitor unit 150. The audio signal S is now additionally (wirelessly) transmitted by way of the second transmission path HD from the microphone 110 directly to the (in-ear) monitor unit 150 where it arrives as an audio signal SD with a time delay. The audio signal SD can be altered by way of a transmission function GO in the (in-ear) monitor unit 150 and is then added to the audio signal M01 which has been transmitted by way of the wireless transmission path H2. The sum audio signal MD produced in that way is then output as an output signal to the user.

The mixing desk 130 can mix the audio signal S1 as well as the further signals E and output same as an output audio signal. The output audio signal A can be output to a public or can be recorded.

The transmission path HD can be implemented in such a way that the signal emitted from the microphone 110 for wireless transmission to the mixing desk 130 is also received by the (in-ear) monitor unit 150.

As an alternative thereto however the wireless microphone 110 can also include devices for another additional transmission channel HD provided specifically for direct transmission to the (in-ear) monitor unit 150. In that case the transmission channel HD can be implemented for example wirelessly by way of Bluetooth, by way of given time slots or by way of other processes which are suitable for the short-distance transmission. Particularly in cases in which the microphone 110 is fixed to the body of the user wired transmission HD of the microphone signal S from the microphone 110 to the (in-ear) monitor unit 150 is also a possible option. Optionally the microphone 110 can also be connected to a combined pocket transmitter and receiver. The transmission path HD is then an internal forwarding means for the microphone signal S within the pocket transmitter and receiver.

Figure 4:
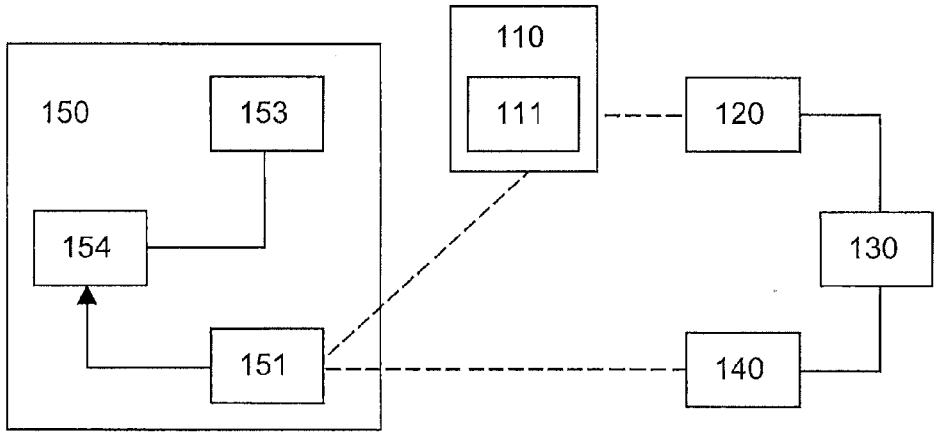
FIG. 4 shows a schematic block circuit diagram of the wireless microphone system according to the first embodiment.

FIG. 4 shows a schematic block circuit diagram of the wireless audio transmission system according to the first embodiment. The wireless audio transmission system has at least one wireless microphone 110 with a wireless transmitter 111. The wireless transmitter 111 transmits the audio signal detected by the microphone 110 as a first audio signal to a first wireless receiver 120. The output signal of the first wireless receiver 120 can optionally not be mixed in a mixing desk 130 with other audio signals E for the second audio signal. The result (the second audio signal) can then be transmitted by way of the second transmitter 140 as a second audio signal (without the first audio signal). The wireless microphone system also has at least one in-ear monitor unit 150. The in-ear monitor unit 150 optionally has at least one second receiver 151, a mixing unit 154 and an audio output 153 to which an earphone 160 can be connected to output or reproduce an audio signal. In the first embodiment the receiver 151 can receive both the first audio signal by way of the first transmission path from the first transmitter 111 and also the second audio signal from the second transmitter 140 by way of the third transmission path. As an alternative thereto it is possible to provide two separate receivers, one receiving the signal of the first transmitter 111 and one receiving the signal of the second transmitter 140. The two received signals are then mixed together in the mixing unit 154.

According to the invention transmission of the first audio signal S1 from the microphone 110 to the first receiver 120 and the second receiver 151 can be based on the same transmission protocol. As an alternative thereto it is also possible to employ different transmission protocols. Thus the transmitter 111 of the microphone 110 can transmit for example by way of two independent radio processes or radio protocols (for example LTE or Dect). In the transmission of the audio signal directly from the transmitter 111 to the receiver 150 preferably a transmission process which has a very low level of latency is used.

According to the invention transmission from the transmitter 111 to the receiver 151 can be effected without a licence for example in the region around 2.4 kHz or 5 kHz.

By virtue of the direct transmission of the first audio signal from the transmitter 111 to the receiver 151 based on a transmission process with a low level of latency the remaining transmission of the first audio signal can be effected by way of the first receiver 120 with a higher permissible latency. In that case the transmission can be based for example on a ZigBee, wifi protocol and an IEEE 802.11 protocol. Transmission of the audio signal by way of the first receiver can also be designed to be substantially more robust. The process according to the invention is intended to ensure that the delay of the signal produced in the in-ear monitor unit does not exceed a threshold value of for example 20 ms.

According to an aspect of the present invention the transmitter 111 sends the first audio signal based on a first transmission protocol. The first receiver 120 and the receiver 151 in the in-ear monitor unit 150 are both designed to be able to process that transmission protocol so that the wireless microphone system according to the invention manages with one instead of with two transmission functions.

According to the invention it is possible to use a wideband transmission process in a time slot process.

According to the invention the first audio signal S1 transmitted directly from the wireless transmitter by way of the first transmission path is mixed with the second audio signal transmitted by way of the third transmission path H2 (which does not contain the first audio signal) in the in-ear monitor 150 and is output as an output signal MD.

According to the invention the wireless audio transmission system, besides the wireless microphone (or in addition thereto) can have at least one wireless pocket transmitter which corresponds in its function to the function of the wireless microphone.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A wireless audio transmission system comprising:

at least one wireless transmitter configured to wirelessly transmit a detected audio signal as a first audio signal by way of at least one first wireless transmission path;

a mixing desk unit configured to:

receive the first audio signal transmitted by way of the first wireless transmission path for mixing said first audio signal;

receive additional audio signals and mix the additional audio signals with the first audio signal to create a first audio output signal configured to be output to a public or recorded;

produce a second output signal based on the additional audio signals; and transmit the second audio output signal by way of a third transmission path;

at least one monitor unit configured to:

receive the first audio signal transmitted by way of a second transmission path;

receive the second output audio signal transmitted by way of the third transmission path;

mix the first audio signal, transmitted by way of the second transmission path, and the second audio output signal to create a mixed signal; and output the mixed signal as an output signal.

2. The wireless audio transmission system as set forth in claim 1, further comprising:

at least one first wireless receiver configured to receive the first audio signal by way of the first wireless transmission path; and a second wireless transmitter configured to wirelessly transmit a second audio signal by way of the third transmission path.

3. The wireless audio transmission system as set forth in claim 1;

wherein the at least one wireless transmitter is a wireless microphone or a wireless pocket transmitter;

wherein the wireless microphone or wireless pocket transmitter comprises a first wireless transmitter for wirelessly transmitting the first audio signal based on a first transmission protocol by way of the first wireless transmission path; and wherein the monitor unit comprises a wireless receiver for directly receiving the first audio signal wirelessly transmitted by way of the second wireless transmission path based on the first transmission protocol.

4. The wireless audio transmission system as set forth in claim 3;

wherein the wireless microphone or the wireless pocket transmitter further comprises:

a second wireless transmitter;

wherein the first wireless transmitter is configured to transmit the first audio signal based on the first transmission protocol and the second wireless transmitter is configured to transmit the first audio signal based on a second transmission protocol;

wherein the monitor unit further comprises a first and a second transmitter configured to receive the first and second audio signals based on the first and second transmission protocols; and wherein the first and second audio signals are configured to be mixed in the monitor unit and output as an output signal.

5. The wireless audio transmission system as set forth in claim 1;

wherein the mixing desk unit is configured to produce a signal to be reproduced without the first audio signal.

6. A process for wireless audio transmission comprising the following steps:

wirelessly transmitting a detected audio signal as a first audio signal from a wireless transmitter by way of at least one first wireless transmission path;

receiving an audio signal corresponding to the first audio signal transmitted by way of the first wireless transmission path in a mixing unit;

receiving additional audio signals in the mixing unit;

mixing said audio signal and said additional received audio signals;

creating a first audio output signal in the mixing unit configured to be output to a public or recorded;

producing a second output signal based on the additional audio signals in a mixing unit;

transmitting the second audio output signal by way of a third transmission path;

directly receiving the first audio signal transmitted by way of a second transmission path in a monitor unit;

receiving the second output audio signal transmitted by way of the third transmission path in the monitor unit;

mixing the first audio signal, transmitted by way of the second transmission path, and the second audio output signal in the monitor unit to create a mixed signal; and outputting the mixed signal as an output signal.

7. The wireless audio transmission system as set forth in claim 2;

wherein the at least one wireless transmitter is a wireless microphone or a wireless pocket transmitter;

wherein the wireless microphone or wireless pocket transmitter comprises a first wireless transmitter for wirelessly transmitting the first audio signal based on a first transmission protocol by way of the first wireless transmission path; and wherein the monitor unit comprises a wireless receiver for directly receiving the first audio signal wirelessly transmitted by way of the second wireless transmission path based on the first transmission protocol.

8. The wireless audio transmission system as set forth in claim 2;

wherein the mixing desk unit is configured to produce a signal to be reproduced without the first audio signal.

9. The wireless audio transmission system as set forth in claim 3;

wherein the mixing desk unit is configured to produce a signal to be reproduced without the first audio signal.

10. The wireless audio transmission system as set forth in claim 4;

wherein the mixing desk unit is configured to produce a signal to be reproduced without the first audio signal.

* * * * *